US010655483B2

(12) United States Patent
Schlemmer et al.

(10) Patent No.: US 10,655,483 B2
(45) Date of Patent: May 19, 2020

(54) RUN-UP SURFACE FOR THE GUIDE-VANE SHROUD PLATE AND THE ROTOR-BLADE BASE PLATE

(71) Applicant: MTU Aero Engines AG, Munich (DE)

(72) Inventors: Markus Schlemmer, Mainburg/Sandelzhausen (DE); Martin Pernleitner, Dachau (DE); Manfred Dopfer, Unterschleissheim (DE); Marcus Woehler, Inning am Ammersee (DE); Oliver Thiele, Dachau (DE); Bernd Kislinger, Reisgang (DE); Norman Cleesattel, Zorneding (DE); Christoph Lauer, Munich (DE); Manfred Schill, Munich (DE); Manuel Hein, Karlsfeld (DE)

(73) Assignee: MTU Aero Engines AG, Munich (DE)

( * ) Notice: Subject to any disclaimer, the term of this patent is extended or adjusted under 35 U.S.C. 154(b) by 623 days.

(21) Appl. No.: 15/366,260

(22) Filed: Dec. 1, 2016

(65) Prior Publication Data

US 2017/0159464 A1 Jun. 8, 2017

(30) Foreign Application Priority Data

Dec. 4, 2015 (DE) ..... 10 2015 224 259

(51) Int. Cl.
*F01D 9/04* (2006.01)
*F01D 21/04* (2006.01)
(Continued)

(52) U.S. Cl.
CPC ..... *F01D 9/041* (2013.01); *F01D 5/12* (2013.01); *F01D 11/001* (2013.01); *F01D 21/04* (2013.01);
(Continued)

(58) Field of Classification Search
CPC ..... F01D 9/041; F01D 21/045; F01D 21/04; F01D 11/001; F01D 5/12; F05D 2250/232; F05D 2260/902
See application file for complete search history.

(56) References Cited

U.S. PATENT DOCUMENTS 7,179,049 B2 * 2/2007 Glasspoole ..... F01D 5/143 415/191
8,282,346 B2 * 10/2012 Deodhar ..... F01D 11/001 415/174.5
(Continued)

FOREIGN PATENT DOCUMENTS

DE 102008011746 9/2009
DE 102014205986 10/2015
(Continued)

*Primary Examiner* — Eldon T Brockman
(74) *Attorney, Agent, or Firm* — Davidson, Davidson & Kappel, LLC

(57) ABSTRACT

A guide vane segment 10 for a turbomachine includes a radially inner shroud plate 13 having a shroud plate surface 14 that is adapted to be configured in the turbomachine to face a rotor blade 20 adjacent to the guide vane segment, and thereby essentially extend along an outer conical surface $K_1$ whose cone axis coincides with the axis of rotation A of a rotor shaft 30. In a radially inner region, a rotor blade 20 for a turbomachine has a base plate 23 having a base plate surface 24 that is adapted to be configured in the turbomachine to face a shroud of a guide vane row 10 adjacent to the rotor blade and thereby essentially extend along an outer conical surface $K_2$ whose cone axis coincides with the axis of rotation A of a rotor shaft 30.

16 Claims, 2 Drawing Sheets

(51) Int. Cl.

| | |
|---|---|
| ***F01D 11/00*** | (2006.01) |
| ***F01D 5/12*** | (2006.01) |
| ***F01D 21/06*** | (2006.01) |

(52) U.S. Cl.

CPC ..... *F01D 21/045* (2013.01); *F01D 21/06* (2013.01); *F05D 2220/32* (2013.01); *F05D 2240/12* (2013.01); *F05D 2240/24* (2013.01); *F05D 2250/232* (2013.01); *F05D 2260/90* (2013.01); *F05D 2260/902* (2013.01)

(56) References Cited

U.S. PATENT DOCUMENTS

| | | | | |
|---|---|---|---|---|
| 8,753,070 | B2 | 6/2014 | Elorza Gomez | |
| 2006/0127214 | A1* | 6/2006 | Glasspoole | F01D 5/143 415/191 |
| 2007/0243061 | A1 | 10/2007 | Taylor et al. | |
| 2010/0254806 | A1* | 10/2010 | Deodhar | F01D 11/001 415/173.7 |
| 2013/0017095 | A1 | 1/2013 | Lee et al. | |
| 2014/0205443 | A1 | 7/2014 | Lee | |
| 2015/0040567 | A1 | 2/2015 | Lu et al. | |
| 2015/0275683 | A1 | 10/2015 | Humhauser et al. | |
| 2016/0160657 | A1* | 6/2016 | Lewis | F01D 5/187 415/115 |
| 2016/0177755 | A1* | 6/2016 | Porter | F01D 9/02 415/208.1 |

FOREIGN PATENT DOCUMENTS

| | | |
|---|---|---|
| EP | 2236748 | 10/2010 |
| WO | WO2015/119699 | 8/2015 |

* cited by examiner

RUN-UP SURFACE FOR THE GUIDE-VANE SHROUD PLATE AND THE ROTOR-BLADE BASE PLATE

This claims the benefit of German Patent Application DE102015224259.5, filed Dec. 4, 2015 and hereby incorporated by reference herein.

The present invention relates to a guide vane segment for a turbomachine, to a rotor blade for a turbomachine, and to a component assembly for a turbomachine.

BACKGROUND

Turbomachines (such as aircraft engines and stationary gas turbines) have a rotor that includes a plurality of rotor blades, as well as at least one axially adjacent guide vane row. The guide vanes are used for optimizing the flow conditions for the rotor blades; the guide vanes and the rotor blades are serially disposed in the primary flow direction. Along the lines of the present invention, the term "guide vane" or "guide vane segment" is to be broadly understood, in particular in the sense of a "stator ring." Thus, this term also encompasses flow-deflecting profiles which, as constituent parts of what is generally referred to as a turbine exit case, are disposed axially downstream of the last rotor blade row of a low-pressure turbine, as well as flow-deflecting profiles, which, as constituent parts of a turbine intermediate case, are disposed between two turbine regions, such as the low-pressure turbine and the high-pressure turbine, for example.

A guide vane row may include a radially inner and a radially outer shroud, as well as a plurality of guide vane airfoils disposed therebetween; in this text, the designations "radial," "axial," and "circumferential" always relate—unless indicated otherwise—to the axis of rotation of an (existing or intended) rotor shaft that is surrounded by the guide vane row. The axis of rotation generally corresponds to what is commonly known as the machine axis of the turbomachine. The guide vane row can be composed of a plurality of guide vane segments, which can each include a radially inner and/or a radially outer shroud plate, as well as a guide vane airfoil or a plurality of guide vane airfoils. Together, the radially inner shroud plates thereby form the inner shroud, and the radially outer shroud plates, the outer shroud; in each case, the shrouds are preferably configured as a closed ring which forms a radial delimitation for the main gas flow.

Analogously, in a radially inner region, the rotor blades can have a base plate that is adapted to be secured to a rotor shaft via a blade root that is insertable or inserted into a rotor disk, for example. A base plate of this kind preferably has an axial projection that, together with a shroud of a guide vane row facing the projection, is adapted for diminishing any radial leakage flow.

Turbomachines having such guide vane assemblies and rotor blade assemblies have been continually improved over the course of time. The publications, German Patent Application DE 10 2008 011 746 A1, U.S. Patent Application 2007/0243061 A1 and European Patent Application EP 2 236 748 A1, describe options for reducing disadvantageous leakage flows, for example.

SUMMARY OF THE INVENTION

Besides the objective of optimizing turbomachine functioning, it is also necessary to consider the possibility of damage, however. In particular, it turns out that a breakage of the rotor shaft may result in significant disadvantages. It is an object of the present invention to provide a method for reducing the negative effects of such a rotor shaft breakage.

The objective is achieved by a guide vane segment, a rotor blade, a component assembly for a turbomachine, and a turbomachine. Advantageous specific embodiments are described in the Specification, and the figures.

An inventive guide vane segment for a turbomachine has at least one guide vane having a radially inner shroud plate; the attribute "radially inner" thereby relates to an intended or already realized configuration of the guide vane segment in a turbomachine (respectively, on the axis of rotation thereof). The shroud plate has a shroud plate surface that is adapted to be configured in the turbomachine to face a rotor blade row that is adjacent to the guide vane segment, in particular upstream thereof. The shroud plate surface thereby essentially extends along an (imaginary) outer conical surface whose cone axis coincides with the axis of rotation of a rotor shaft.

In particular, the guide vane segment is thus adapted to be combined with one or a plurality of further guide vane segments and to thereby form an annular guide vane row whose central axis coincides with the axis of rotation of the rotor shaft. The shroud plate surface is thereby formed axially of an, in particular, upstream, adjacently disposed rotor blade row and extends along the outer conical surface (which is preferably the outer surface of a straight circular cone); thus, is conically formed relative to the axis of rotation. A proper assembly of the guide vane segment provides that the shroud plate surface be preferably configured on the front side of the shroud plate—viewed in a designated direction of primary flow.

One advantageous specific embodiment provides that a guide vane segment according to the present invention additionally have a radially outer shroud plate; analogously to the above, the attribute "radially outer" relates here to an intended or already realized configuration of the guide vane segment in a turbomachine (and the axis of rotation thereof). At least one guide vane airfoil is preferably configured between the radially inner and such a radially outer shroud plate.

An inventive rotor blade for a turbomachine features a base plate in a radially inner region (for example, in one third, one fourth or one fifth of an extent of the rotor blade in the radial direction that faces or is to face the rotor shaft); this base plate has a base plate surface that is adapted to be configured in the turbomachine to face a shroud of a guide vane row adjacent to the rotor blade and to thereby essentially extend along an (imaginary) outer conical surface whose cone axis coincides with the axis of rotation of a rotor shaft. A proper assembly of the rotor blade provides that the base plate surface preferably be configured on the rear side of the base plate—viewed in a designated direction of primary flow.

In particular, the base plate surface (obliquely) faces a guide vane row in the axial direction and extends along the outer conical surface (which is preferably the outer surface of a straight circular cone); is thus formed conically to the axis of rotation.

An inventive component assembly for a turbomachine, as well as an inventive turbomachine each feature a guide vane segment according to the present invention in accordance with one of the specific embodiments described in this text and an inventive rotor blade in accordance with one of the specific embodiments described in this text, the rotor blades preferably being axially configured upstream of the guide vane segment.

By the respective shroud plate surface, respectively base plate surface extending conically to the axis of rotation, a guide vane segment according to the present invention and a rotor blade according to the present invention each feature a run-up surface, capable of braking the rotor in the event of a rotor shaft breakage. For this, it is especially advantageous to use a combination of a guide vane segment according to the present invention and of a rotor blade according to the present invention, where the shroud plate surface and the base plate surface are able to run up against each other in the event of a rotor shaft breakage (where they are essentially configured at the same radial distance from the rotor shaft, for example); it is especially beneficial when the respective outer conical surfaces essentially feature the same cone angle. In the event of a rotor shaft breakage and a resulting running up of the base plate surface onto the adjacent shroud plate surface, substantial frictional forces may be generated here, which, accordingly, effect a braking.

Accordingly, an advantageous specific embodiment of a component assembly according to the present invention, respectively of a turbomachine according to the present invention provides that the outer conical surfaces, along which the (mentioned) shroud plate surface of the guide vane segment, respectively the (mentioned) base plate surface of the rotor blades extend, essentially have the same cone angle.

The shroud plate surface and the base plate surface are preferably configured in a turbomachine according to the present invention essentially at the same radial distance from the rotor shaft.

In accordance with one advantageous specific embodiment, the shroud plate surface of a guide vane segment according to the present invention is oriented radially inwardly, thus, adapted to be configured in a turbomachine to (obliquely) face the rotor shaft. Thus, by the mentioned outer conical surface, the shroud plate surface is adjacent to an outer surface of a cone.

In contrast, the base plate surface of a rotor blade according to the present invention is advantageously directed radially outwardly, thus, is adapted to be configured to face away from the rotor shaft in a turbomachine. Thus, by the mentioned outer cone surface, the base plate surface is adjacent to an inner surface of a cone.

In the event of a rotor shaft breakage and a resulting running up of the shroud plate surface onto the base plate surface, a shroud plate surface, respectively base plate surface oriented in this manner cause the guide vane segment to be urged radially outwardly (for example, against a vane ring case), and the guide vanes radially inwardly against the rotor shaft. The result is an especially effective braking of the rotor.

One advantageous specific embodiment of a guide vane segment according to the present invention provides that the outer conical surface, along which the shroud plate surface extends, be angled at most by 80°, preferably at most by 60°, more preferably at most by 50° relative to the axis of rotation of the rotor shaft. Thus, the corresponding cone features a cone angle of at most 160°, 120°, respectively 100°.

Analogously, the outer conical surface, along which the base plate surface of a rotor blade according to the present invention extends, is preferably angled relative to the axis of the rotor shaft at most by 80°, preferably at most by 60°, more preferably by at most 50°; thus, the corresponding cone has a cone angle of at most 160°, 120°, respectively 100°.

Such angles make possible an especially effective braking in the event of a rotor shaft breakage and a running up of the shroud plate onto a base plate of an adjacent rotor blade, while avoiding further damage caused by the guide vane segment and the rotor blades colliding.

The guide vanes and rotor blades of the turbomachine according to the present invention are preferably thereby designed in such a way that, in the event of a shaft breakage and an associated translational displacement of the rotor blade row axially rearwardly, i.e., in the direction of flow, first the shroud plate surface of the radially inner shroud plate of the guide vane segment comes into contact with the base plate surface of the base plate of the rotor blade. In this manner, in the event of a shaft breakage, the rotational energy of the broken-off fragment of the rotor may be dissipated in a predetermined component section of the turbomachine, i.e., converted into frictional heat. The surface area used for this purpose is thereby configured to be relatively large in comparison to the related art due to the inclination of the shroud plate surface and/or the base plate surface relative to the axis of rotation. Moreover, a portion of the force, that presses the broken-off fragment of the rotor axially rearwardly in response to the flow acting on the rotor blades, is advantageously radially deflected upon the running up onto the shroud plate surfaces of the guide vane segments, due to the previously described inclination of the contact surfaces in the radial direction. This makes possible a more lightweight design for the guide vanes, without the risk of their likewise breaking off in the event of a shaft breakage.

BRIEF DESCRIPTION OF THE DRAWING

Preferred exemplary embodiments of the present invention will be described in greater detail in the following with reference to the drawing. It is understood that different combinations of individual elements and components are possible other than those explained. Reference numerals for corresponding elements are used throughout the figures and, as the case may be, are not newly specified for each figure.

Schematically shown in.

DETAILED DESCRIPTION OF AN EMBODIMENT

Figure 1:
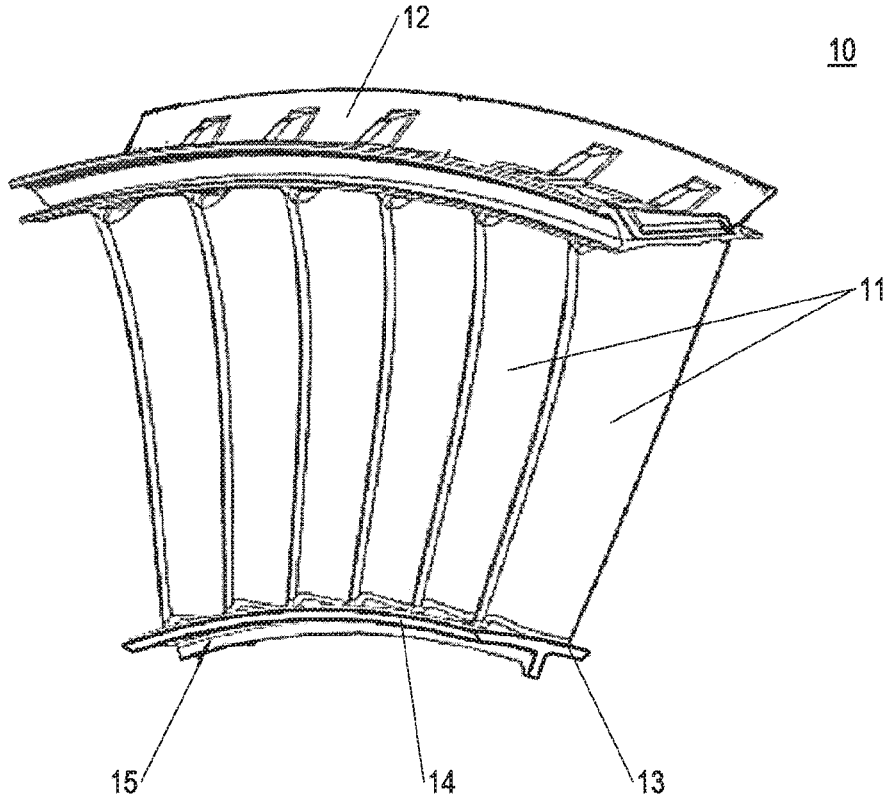
FIG. 1: is an exemplary guide vane segment according to the present invention in a perspective view.

FIG. 1 shows a guide vane segment 10 in accordance with a specific embodiment of the present invention. Guide vane segment 10 includes an outer shroud plate 12 and an inner shroud plate 13, which each delineate segments of shrouds that are disposed one inside the other and have the same central axis; configured between outer shroud plate 12 and inner shroud plate 13 are a plurality of airfoils 11. Together with other, analogously configured guide vane segments, guide vane segment 10 is adapted to form a guide vane row that extends as a ring about a rotary shaft, respectively machine axis of the turbomachine. The axis of rotation thereof thereby essentially coincides with a central axis of the guide vane row, and airfoils 11 essentially extend radially relative thereto.

On the side thereof facing the central axis, radially inner shroud plate 13 features a fastening element 15 for fastening at least one seal that, in particular, may include at least one sealing ring.

At the front axial side thereof in the representation of FIG. 1, shroud plate 13 has a shroud plate surface 14 that is adapted to be configured in the turbomachine to face a rotor blade that is axially adjacent to guide vane segment 10. Shroud surface 14 is thereby conically chamfered; thus, extends essentially along an (imaginary) outer conical surface about the central axis (and thus about the axis of rotation of the rotor shaft). This is clarified with reference to FIGS. 2 and 3.

Figure 2:
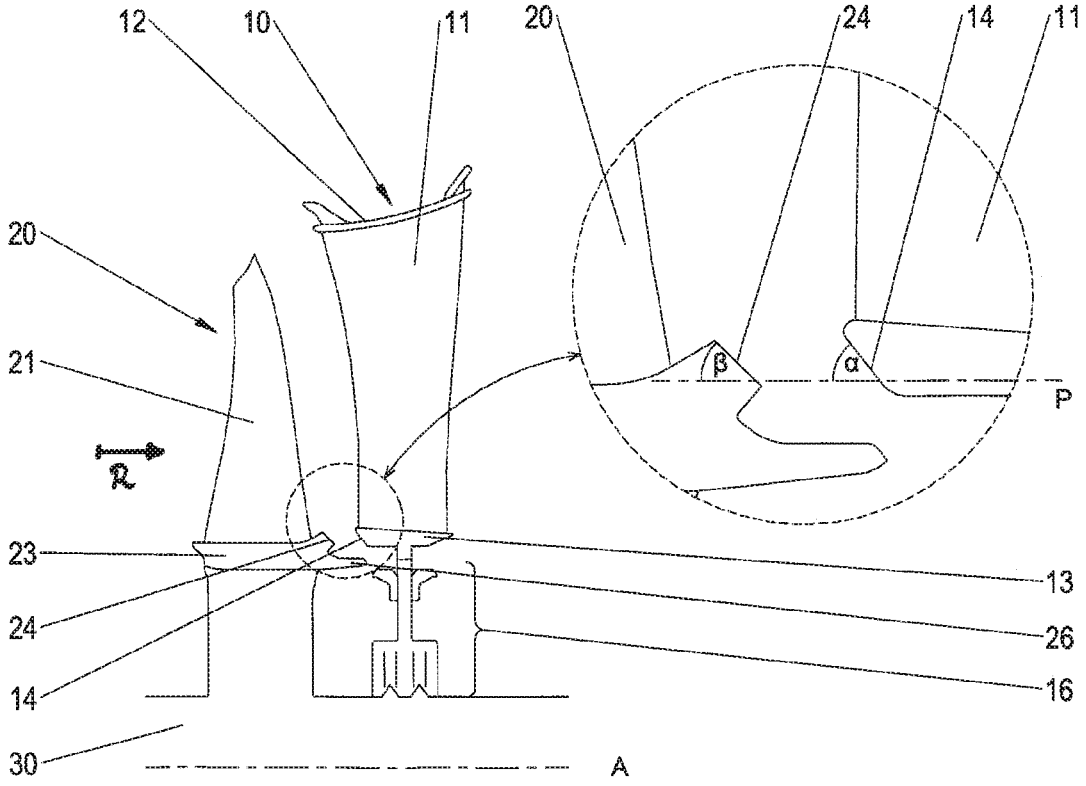
FIG. 2: is a configuration of an exemplary guide vane segment according to the present invention and of an exemplary rotor blade according to the present invention in a sectional view.

FIG. 2 schematically shows a configuration of an exemplary guide vane segment 10 according to the present invention and of an exemplary rotor blade 20 according to the present invention in a sectional view; this configuration may be present, for example, in a turbomachine according to the present invention, in particular in a turbine section of the same.

Rotor blade 20 is coupled to a rotor shaft 30 and adapted to rotate therewith about axis of rotation A thereof. Moreover, this axis of rotation is a central axis of the illustrated configuration, relative to which rotor blades 20 and airfoils 11 of the guide vane segment are essentially radially oriented. Direction R of a designated primary flow is from left to right in the illustration of FIG. 2.

Guide vane segment 10 features a radially inner shroud plate 13, a radially outer shroud plate 12, as well as an airfoil 11 therebetween. A sealing element 16 is mounted on radially inner shroud plate 13, preferably radially displaceably, notably by a spoke-centering suspension. This makes it possible to prevent stresses that result from different, thermally induced radial expansions between sealing element 16, on the one hand, and guide vane segment 10, respectively the guide vane row formed from a plurality of such guide vane segments 10, on the other hand, during operation of the turbomachine.

In a radially inner region, rotor blade 20 has a base plate 23, from which a rotor blade airfoil 21 extends radially outwardly. At the side facing guide vane segment 10 (in the axial direction), the base plate has a projection 26, which, together with inner shroud plate 13 of the guide vane segment, reduces a disadvantageous radial flow.

Inner shroud plate 13 of guide vane segment 10 features a shroud plate surface 14 that faces a base plate surface 24 of base plate 23 of rotor blade 20; both of the mentioned surfaces are essentially thereby configured at the same radial distance from rotor shaft 30. Viewed in designated primary flow direction R, base plate surface 24 is configured on a rear side of base plate 23, and shroud plate surface 14 on a front side of shroud plate 13. Thus, in the event of a breakage of the rotor shaft, base plate surface 24 is able to run up onto shroud plate surface 14, so that the rotor is advantageously braked.

Shroud plate surface 14 and base plate surface 24 are each configured along (imaginary) outer conical surfaces; with reference to a parallel P to axis of rotation A, the magnified circular view shows that shroud plate surface 14 and base plate surface 24 are angled by angle $\alpha$ or $\beta$ relative to axis of rotation A; preferably, $\alpha$ or $\beta$ are each at most 80°, preferably at most 60°, more preferably at most 50°. It is especially advantageous when $\alpha$ and $\beta$ are essentially of equal value; this provides both surfaces with an especially large contact area in the case that they run up against each other; a considerable braking friction action resulting therefrom.

Figure 3:
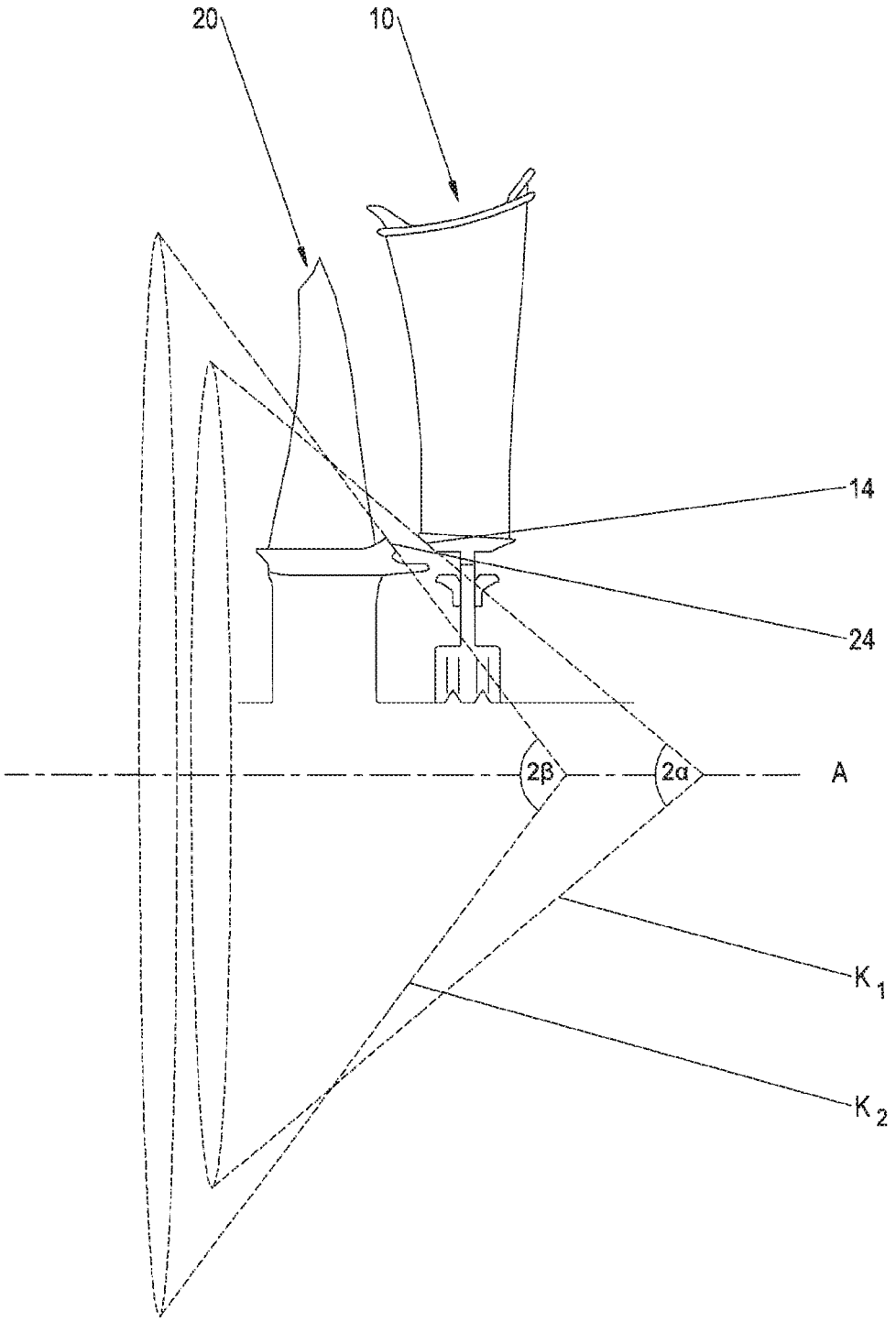
FIG. 3: are portions of the configuration in accordance with FIG. 2, including imaginary conical surfaces for illustration purposes.

FIG. 3 illustrates the configuration according to FIG. 2 including the (imaginary) conical surfaces: as is readily apparent from the figure, shroud plate surface 14 extends along outer conical surface $K_1$, which features a cone angle of $2\alpha$. Analogously, base plate surface 24 extends along outer conical surface $K_2$ that features a cone angle of $2\beta$. In the illustrated example, $\alpha<\beta$; in a modified specific embodiment, these two angles also essentially being able to be of equal value.

A guide vane segment 10 according to the present invention for a turbomachine includes a radially inner shroud plate 13 having a shroud plate surface 14 that is adapted to be configured in the turbomachine to face a rotor blade 20 adjacent to the guide vane segment, and to thereby essentially extend along an outer conical surface $K_1$, whose cone axis coincides with axis of rotation A of a rotor shaft 30.

In a radially inner region, a rotor blade 20 according to the present invention for a turbomachine has a base plate 23 having a base plate surface 24 that is adapted to be configured in the turbomachine to face a shroud of a guide vane row 10 adjacent to the rotor blade and thereby essentially extend along an outer conical surface $K_2$ whose cone axis coincides with axis of rotation A of a rotor shaft 30.

REFERENCE NUMERAL LIST

10 guide vane segment
11 guide vane airfoil
12 radially outer shroud plate
13 radially inner shroud plate
14 shroud plate surface
15 fastening element
16 sealing element
20 rotor blade
21 rotor blade airfoil
23 base plate
24 base plate surface
30 rotor shaft
A central axis or axis of rotation
P parallel to A
$\alpha$ angle between shroud plate surface and A (or P)
$2\alpha$ cone angle of $K_1$
$2\beta$ cone angle of $K_2$
$\alpha$ angle between base plate surface and A (or $\theta$)
$K_1$, $K_2$ outer conical surface

What is claimed is:

1. A guide vane segment for a turbomachine, the guide vane segment comprising:

a radially inner shroud plate having an outwardly facing top surface, an inwardly facing bottom surface, and a conical chamfer connecting the top surface and the bottom surface, the conical chamfer forming an inwardly facing shroud plate surface that faces both a rotor shaft and a rotor blade adjacent to the guide vane segment, an imaginary extension of the conical chamfer extending along an outer conical surface with a cone axis coinciding with the rotor shaft at an axis of rotation of the rotor shaft.

2. The guide vane segment as recited in claim 1 wherein the outer conical surface is angled relative to the axis of the rotor shaft by at most 80°.

3. The guide vane segment as recited in claim 2 wherein the outer conical surface is angled relative to the axis of the rotor shaft by at most 60°.

4. The guide vane segment as recited in claim 3 wherein the outer conical surface is angled relative to the axis of the rotor shaft by at most 50°.

5. A rotor blade for a turbomachine, the rotor blade comprising:

a base plate in a radially inner region having a projection and an outwardly facing base plate surface, the projection and the outwardly facing base plate surface each adapted to be configured in the turbomachine to face away from a rotor shaft and to face a shroud of a guide vane row adjacent to the rotor blade, the outwardly facing base plate surface being conical in that an imaginary extension of the outwardly facing base plate surface extends along an outer conical surface with a cone axis coinciding with the rotor shaft at an axis of rotation of the rotor shaft.

6. The rotor blade as recited in claim 5 wherein the outer conical surface is angled relative to the axis of the rotor shaft by at most 80°.

7. The rotor blade as recited in claim 6 wherein the outer conical surface is angled relative to the axis of the rotor shaft by at most 60°.

8. The rotor blade as recited in claim 7 wherein the outer conical surface is angled relative to the axis of the rotor shaft by at most 50°.

9. A subassembly for a turbomachine comprising:

a guide vane segment for a turbomachine, the guide vane segment including a radially inner shroud plate having a shroud plate surface adapted to be configured in the turbomachine to face a rotor blade as recited in claim 5 adjacent to the guide vane segment and to extend along a guide vane segment outer conical surface with a guide vane segment cone axis coinciding with the axis of rotation of the rotor shaft.

10. The subassembly as recited in claim 9 wherein the guide vane outer conical surface extends along a shroud surface of the guide vane segment, and the outer conical surface extends along a base plate surface of the rotor blade, the guide vane outer conical surface and the outer conical surface having a similar cone angle.

11. A turbomachine comprising:

a guide vane segment, the guide vane segment including a radially inner shroud plate having a shroud plate surface adapted to be configured in the turbomachine to face a rotor blade as recited in claim 6 adjacent to the guide vane segment and to extend along a guide vane segment outer conical surface with a guide vane segment cone axis coinciding with the axis of rotation of the rotor shaft.

12. The turbomachine as recited in claim 11 wherein the guide vane segment outer conical surface extends along a shroud surface of the guide vane segment, and the outer conical surface extends along a base plate surface of the rotor blade, the guide vane segment outer conical surface and the outer conical surface having a similar cone angle.

13. A turbomachine comprising:

a rotor shaft;

a rotor blade attached to the rotor shaft; and a guide vane segment, the guide vane segment comprising a radially inner shroud plate having an outwardly facing top surface, an inwardly facing bottom surface, and a conical chamfer connecting the top surface and the bottom surface, the conical chamfer forming an inwardly facing shroud plate surface that faces the rotor blade, an imaginary extension of the conical chamfer extending along an outer conical surface with a cone axis coinciding with the rotor shaft at an axis of rotation of the rotor shaft; and the rotor blade comprising a base plate in a radially inner region having a projection and an outwardly facing base plate surface, the projection and the outwardly facing base plate surface each adapted to be configured in the turbomachine to face away from the rotor shaft and to face a shroud of a guide vane row adjacent to the rotor blade, the outwardly facing base plate surface being conical in that an imaginary extension of the outwardly facing base plate surface extends along an outer conical surface with a cone axis coinciding with the rotor shaft at the axis of rotation of the rotor shaft.

14. The guide vane segment as recited in claim 13 wherein the outer conical surface is angled relative to the axis of the rotor shaft by at most 80°.

15. The guide vane segment as recited in claim 14 wherein the outer conical surface is angled relative to the axis of the rotor shaft by at most 60°.

16. The guide vane segment as recited in claim 15 wherein the outer conical surface is angled relative to the axis of the rotor shaft by at most 50°.

* * * * *